US012298075B2

(12) United States Patent
Herron et al.

(10) Patent No.: US 12,298,075 B2
(45) Date of Patent: May 13, 2025

(54) PROCESS AND APPARATUS FOR RECOVERY OF AT LEAST NITROGEN AND ARGON

(71) Applicant: Air Products and Chemicals, Inc., Allentown, PA (US)

(72) Inventors: Donn Michael Herron, Fogelsville, PA (US); Qiao Zhao, Macungie, PA (US)

(73) Assignee: AIR PRODUCTS AND CHEMICALS, INC., Allentown, PA (US)

( * ) Notice: Subject to any disclaimer, the term of this patent is extended or adjusted under 35 U.S.C. 154(b) by 394 days.

(21) Appl. No.: 17/878,171

(22) Filed: Aug. 1, 2022

(65) Prior Publication Data

US 2024/0035743 A1 Feb. 1, 2024

(51) Int. Cl.
*F25J 3/04* (2006.01)

(52) U.S. Cl.
CPC ..... *F25J 3/04412* (2013.01); *F25J 3/04018* (2013.01); *F25J 3/04187* (2013.01); *F25J 3/04351* (2013.01); *F25J 3/04363* (2013.01); *F25J 3/04666* (2013.01); *F25J 2200/06* (2013.01); *F25J 2200/34* (2013.01); *F25J 2210/06* (2013.01); *F25J 2210/40* (2013.01); *F25J 2215/42* (2013.01); *F25J 2215/58* (2013.01); *F25J 2270/42* (2013.01); *F25J 2270/50* (2013.01)

(58) Field of Classification Search
None
See application file for complete search history.

(56) References Cited

U.S. PATENT DOCUMENTS

| | | | | |
|---|---|---|---|---|
| 2,982,107 | A * | 5/1961 | Donald | F25J 3/04242 62/651 |
| 4,022,030 | A | 5/1977 | Brugerolle | |
| 4,818,262 | A | 4/1989 | Brugerolle | |
| 4,822,395 | A | 4/1989 | Cheung | |
| 6,397,632 | B1 | 6/2002 | Meagher | |
| 2019/0331416 | A1 * | 10/2019 | Prosser | F25J 3/04715 |
| 2019/0331417 | A1 | 10/2019 | Kromer et al. | |
| 2019/0331418 | A1 | 10/2019 | Prosser et al. | |
| 2019/0331419 | A1 | 10/2019 | Handley et al. | |
| 2021/0364232 | A1 | 11/2021 | Saulnier et al. | |
| 2022/0221221 | A1 | 7/2022 | Herron et al. | |

FOREIGN PATENT DOCUMENTS

| | | | |
|---|---|---|---|
| JP | 51049197 | A | 4/1976 |
| WO | 2020169257 | A1 | 8/2020 |
| WO | 202244801 | A1 | 12/2020 |
| WO | 2021078405 | A1 | 4/2021 |

* cited by examiner

*Primary Examiner* — Jenna M Maroney
(74) *Attorney, Agent, or Firm* — Matthew Richard Weaver

(57) ABSTRACT

A process for recovering at least one fluid (e.g. argon gas and/or nitrogen gas, etc.) from a feed gas (e.g. air) can provide an improved recovery of argon and/or nitrogen as well as an improvement in operational efficiency. Some embodiments can be adapted so that at least a portion of a mixed nitrogen-oxygen fluid is at least partially vaporized and fed to a low pressure column.

20 Claims, 5 Drawing Sheets

PROCESS AND APPARATUS FOR RECOVERY OF AT LEAST NITROGEN AND ARGON

FIELD OF THE INVENTION

The present innovation relates to processes utilized to recover fluids from air (e.g. oxygen, argon and nitrogen) that include at least argon and nitrogen, gas separation plants configured to recover at least nitrogen and argon from at least one feed gas, air separation plants, air separation systems, systems utilizing multiple columns to recover nitrogen, argon, and oxygen fluids, and methods of making and using the same.

BACKGROUND OF THE INVENTION

Electronic chip manufacturers have traditionally required nitrogen gas for their facilities. Air separation processing was utilized to provide nitrogen gas for such facilities. Examples of systems that were developed in conjunction with air separation processing include U.S. Pat. Nos. 4,022,030 and 4,822,395, International Patent Publication Nos. WO2020/169257, WO2020/244801, WO2021/078405 and U.S. Pat. App. Pub. Nos. 2019/0331417, 2019/0331418, and 2019/0331419.

Chip manufacturing facilities often utilized air separation processes designed to produce predominantly nitrogen gas flows as well as waste oxygen. The waste oxygen contained most of the oxygen and argon in the incoming air, plus some unrecovered nitrogen. A typical waste oxygen output flow composition from such facilities is 65% oxygen, 3% argon, and 32% nitrogen.

More recently, some manufacturers may require the air separation plant in their facility to supply high purity argon as well as nitrogen. Typically, such systems are designed so that the oxygen purity of the oxygen waste output flow must be greater than 99.5% to 99.9% oxygen, zero nitrogen, and the balance argon.

SUMMARY

We have determined that some air separation processes designed to provide high-purity nitrogen and argon fluids for use by a manufacturing facility (e.g. a chip manufacturing facility or other facility that may have such needs, etc.) can often produce large quantities of high-purity oxygen, which has little or no value to the facility operator. We have determined that such air separation processing can be designed to reduce the power needed to form nitrogen and argon fluid flows or to provide improved recovery of argon. Embodiments can also be configured to provide a more environmentally friendly operation of a plant or process. Moreover, we have determined that embodiments can be designed to provide enhanced argon recovery that depends on the particular configuration of an underlying oxygen/nitrogen separation process that may already be utilized at a plant so that the plant can be upgraded to provide argon recovery or provide improved argon recovery without a substantial increase in power consumption. We have also determined that other embodiments can be designed to provide enhanced argon recovery that depends on the particular configuration of an underlying oxygen/nitrogen separation process that may already be utilized at a plant so that the plant can embodiments can be designed to provide enhanced argon recovery that depends on the particular configuration of an underlying oxygen/nitrogen separation process that may already be utilized at a plant so that the plant can provide a significant improvement in argon recovery that offsets the increase in power that may be required for providing the improved argon recovery.

In a first aspect, a process for separation of a feed gas comprising oxygen, nitrogen, and argon can include compressing a feed gas via a compression system of a separation system having at least a first column and a second column. The first column can be a high pressure (HP) column operating at a pressure that is higher than the second column. The second column can be a low pressure (LP) column operating at a pressure that is lower than the first column. The process can also include feeding a first feed stream portion of the compressed feed gas to a first heat exchanger to cool the first feed stream portion of the compressed feed gas, feeding the cooled first feed stream portion of the compressed feed gas to the HP column to produce an HP nitrogen-rich vapor stream and an HP oxygen-enriched stream, condensing a first portion of the HP nitrogen-rich vapor stream via an HP reboiler-condenser to form an HP condensate stream so that a first portion of the HP condensate stream is recyclable to the HP column, and outputting at least a LP nitrogen-enriched stream, a first LP oxygen-enriched stream, and an LP argon-enriched stream from the LP column. The first LP oxygen-enriched stream can have an oxygen content of at least 97 mole percent (mol %) oxygen (e.g. in a range of 97 mol % oxygen to 100 mol % oxygen). The process can also include feeding the LP argon-enriched stream to a third column to form an argon-rich vapor and an argon-depleted liquid. The third column can be an argon-enrichment (AE) column. The process can additionally include feeding the formed argon-rich vapor to an AE column reboiler-condenser, feeding the argon-depleted liquid to the LP column, at least partially condensing the argon-rich vapor output from the AE column via the AE column reboiler-condenser, and mixing the LP nitrogen-enriched stream output from the LP column with the first LP oxygen-enriched stream output from the LP column to form a first mixed nitrogen-oxygen fluid to feed to the AE column reboiler-condenser where it is at least partially vaporized to provide at least a portion of a refrigeration duty of the AE column reboiler-condenser for at least partially condensing the first argon-rich vapor. The process can also include feeding a first portion of the at least partially vaporized first mixed nitrogen-oxygen fluid to the LP column.

In a second aspect, the mixing of the LP nitrogen-enriched stream output from the LP column with the first LP oxygen-enriched stream output from the LP column to form the first mixed nitrogen-oxygen fluid to feed to the AE column reboiler-condenser of the can include feeding of the LP nitrogen-enriched stream to a mixing device so that an entirety of the LP nitrogen-enriched stream is fed to the mixing device or only a first portion of this LP nitrogen-enriched stream being fed to the mixing device while a second portion is split from the first portion of the LP nitrogen-enriched stream for being mixed with a second mixed nitrogen-oxygen fluid stream output from the mixing device or is split from the first portion of the LP nitrogen-enriched stream for being fed separately to a first heat exchanger for being output as a separate product stream, a process stream for use in another plant process (e.g. a regeneration stream), or as a waste stream for venting to the atmosphere.

In a third aspect, the process can also include splitting the compressed feed gas into the first feed stream portion and a second feed stream portion, feeding the second feed stream portion of the compressed feed gas to the first heat exchanger to cool the second feed stream portion of the compressed feed gas, and feeding the cooled second feed stream portion of the compressed feed gas to a fourth column to produce a nitrogen-rich vapor stream and an oxygen-enriched stream. The fourth column can operate at a pressure that is greater than the pressure at which the HP column operates (e.g. it can be considered an elevated pressure column, for example, etc.). The process of the third aspect can also include warming at least a portion of the nitrogen-rich vapor stream output from the fourth column in the first heat exchanger to provide a nitrogen product stream, feeding the oxygen-enriched stream output from the fourth column to the HP column, splitting the HP condensate stream into the first portion of the HP condensate stream and a second portion of the HP condensate stream, and feeding the second portion of the HP condensate stream to the fourth column at or adjacent a top of the fourth column.

In a fourth aspect, the process can also include splitting the nitrogen-rich vapor formed via a fourth column (e.g. the fourth column of the third aspect) into a first portion of the nitrogen-rich vapor that is output from the fourth column and a second portion of the nitrogen-rich vapor that is output from the fourth column, warming the first portion of the nitrogen-rich vapor output from the fourth column in the first heat exchanger to provide the nitrogen product stream, and condensing the second portion of the nitrogen-rich vapor via a fourth column reboiler-condenser to form a condensate that is recyclable to the fourth column. Also, the feeding of the oxygen-enriched stream output from the fourth column to the HP column as discussed above in the third aspect can include passing the oxygen-enriched stream output from the fourth column to the fourth column reboiler-condenser to at least partially vaporize the oxygen-enriched stream for feeding it to the HP column.

In a fifth aspect, the process can also include splitting the HP oxygen-enriched stream output from the HP column into a first portion and a second portion and mixing the first mixed nitrogen-oxygen fluid with the second portion of the HP oxygen-enriched stream for feeding the first mixed nitrogen-oxygen fluid to the AE column reboiler-condenser to provide at least a portion of a refrigeration duty of the AE column reboiler-condenser for the at least partially condensing of the first argon-rich stream.

It should be appreciated that the mixing of a second portion of the HP oxygen enriched stream with the first mixed nitrogen-oxygen fluid can result in the first mixed nitrogen-oxygen fluid that is fed to the second reboiler-condenser having a higher oxygen content. The first mixed nitrogen-oxygen fluid output from a mixing device that can be fed to the second reboiler-condenser can be fed to the second reboiler-condenser when it is mixed with an oxygen enriched portion of the HP oxygen enriched stream as well as when it is not mixed with that portion of the HP oxygen enriched stream to provide at least a portion of a refrigeration duty of the second column reboiler-condenser (which can also be referred to as an AE column reboiler-condenser) for at least partially condensing the first argon-rich vapor.

In a sixth aspect, the mixing of the LP nitrogen-enriched stream output from the LP column with the first LP oxygen-enriched stream output from the LP column to form the first mixed nitrogen-oxygen fluid to feed to the AE column reboiler-condenser can include mixing the LP nitrogen-enriched stream output from the LP column with the first LP oxygen-enriched stream output from the LP column and a portion of the HP oxygen-enriched stream for forming the first mixed nitrogen-oxygen fluid. This portion of the HP oxygen-enriched stream can be considered a first portion of this stream while a second portion of this stream is fed to the LP column or this portion of the HP oxygen-enriched stream can be considered a second portion while a first portion of the HP oxygen-enriched stream is fed to the LP column. In some situations, where the HP oxygen-enriched stream can be split into more than two portions, the portion of the HP oxygen-enriched stream fed to a mixing device for mixing with the LP nitrogen-enriched stream output from the LP column with the first LP oxygen-enriched stream output from the LP column can be considered a first portion, a second portion, or a third portion of the HP oxygen-enriched stream.

In a seventh aspect of the process, the process can include passing the first mixed nitrogen-oxygen fluid output from the AE column reboiler-condenser to a phase separator to form a nitrogen-oxygen vapor and a nitrogen-oxygen liquid, feeding the nitrogen-oxygen liquid to the LP column, and mixing the nitrogen-oxygen vapor with a second mixed nitrogen-oxygen fluid output from a mixing device that also outputs the first mixed nitrogen-oxygen fluid.

In an eighth aspect, the process can additionally include passing the first mixed nitrogen-oxygen fluid output from the AE column reboiler-condenser to a phase separator to form a vapor comprising nitrogen and a nitrogen-oxygen liquid and feeding the nitrogen-oxygen liquid output from the phase separator to the LP column. Also, the mixing of the LP nitrogen-enriched stream output from the LP column with the first LP oxygen-enriched stream output from the LP column to form the first mixed nitrogen-oxygen fluid can include mixing the vapor comprising nitrogen output from the phase separator with the LP nitrogen-enriched stream output from the LP column and the first LP oxygen-enriched stream output from the LP column to form the first mixed nitrogen-oxygen fluid and/or a second mixed nitrogen-oxygen fluid.

In a ninth aspect, the mixing of the LP nitrogen-enriched stream output from the LP column with the first LP oxygen-enriched stream output from the LP column can be performed in a single stage mixing device that forms the first mixed nitrogen-oxygen fluid as a liquid and a second mixed nitrogen-oxygen fluid as a vapor. Alternatively, the mixing can be performed via another type of mixing device, such as a multiple stage mixing column or other type of mixing device.

In a tenth aspect, the mixing of the LP nitrogen-enriched stream output from the LP column with the first LP oxygen-enriched stream output from the LP column can be performed in a multiple stage contacting column or a mixing column such that the first LP oxygen-enriched stream is introduced at a top of the multiple stage contacting column or the mixing column and flows downward, the LP nitrogen-enriched stream is introduced at the bottom of the multiple stage contacting column or the mixing column and flows upward, and the first mixed nitrogen-oxygen fluid is output from adjacent the bottom of the multiple stage contacting column or the mixing column as a liquid. A second mixed nitrogen-oxygen fluid can also be recovered from adjacent the top of the multiple stage contacting column or the mixing column as a vapor.

In an eleventh aspect, the process can be performed such that the at least partially condensing of the argon-rich vapor is a complete condensing to form an argon-rich liquid. Alternatively, the at least partially condensing of the argon-rich vapor can be an incomplete condensing so the formed stream includes both argon-rich liquid and argon-rich vapor.

In a twelfth aspect, the first aspect of the process can include one or more of the second aspect, third aspect, fourth aspect, fifth aspect, sixth aspect, seventh aspect, eighth aspect, ninth aspect, tenth aspect or eleventh aspect. For instance, the first aspect can be combined with all of the second through eleventh aspects as an embodiment of the twelfth aspect or can include a combination of one or more such aspects as an embodiment of the twelfth aspect.

In a thirteen aspect, a system for separation of a feed gas comprising oxygen, nitrogen, and argon can include a first column and a second column. The first column can be a high pressure (HP) column operatable at a pressure that is higher than the second column. The second column can be a low pressure (LP) column operatable at a pressure that is lower than the first column. The system can also include a compression system positioned to feed a first feed stream portion of a compressed feed gas to a first heat exchanger to cool the first feed stream portion of the compressed feed gas. The first heat exchanger can be positioned to cool the first feed stream portion of the compressed feed gas output from the compression system to feed the cooled compressed first feed stream portion to the HP column to produce an HP nitrogen-rich vapor stream and an HP oxygen-enriched stream. An HP reboiler-condenser can be positioned to condense a first portion of the HP nitrogen-rich vapor stream to form an HP condensate stream so that a first portion of the HP condensate stream is recyclable to the HP column. The LP column can be positioned and configured to output at least a LP nitrogen-enriched stream, a first LP oxygen-enriched stream, and an LP argon-enriched stream so that the first LP oxygen-enriched stream has an oxygen content of at least 97 mol % oxygen (e.g. an oxygen content of between 97 mol % and 100 mol %). A third column can be positioned to receive the LP argon-enriched stream output from the LP column to form an argon-rich vapor and an argon-depleted liquid. The third column can be an argon-enrichment (AE) column. The AE column can be connected to the LP column so that the argon-depleted liquid output from the third column is feedable to the LP column. An AE column reboiler-condenser can be positioned to receive the argon-rich vapor output from the third column to at least partially condense the argon-rich vapor output from the AE column. A mixing device can be positioned to mix the LP nitrogen-enriched stream output from the LP column with the first LP oxygen-enriched stream output from the LP column to form a first mixed nitrogen-oxygen fluid to feed to the AE column reboiler-condenser so it is at least partially vaporized to provide at least a portion of a refrigeration duty of the AE column reboiler-condenser for at least partially condensing the first argon-rich vapor. The AE column reboiler-condenser can be positioned and connected to the LP column so that a first portion of the at least partially vaporized first mixed nitrogen-oxygen fluid output from the AE column reboiler-condenser is feedable to the LP column.

In a fourteenth aspect, the system can be provided so that it can perform an embodiment of the process of the first aspect, second aspect, third aspect, fourth aspect, fifth aspect, sixth aspect, seventh aspect, eighth aspect, ninth aspect, tenth aspect, eleventh aspect, or twelfth aspect.

In a fifteenth aspect, the system can be provided so that the compression system is connected to the first heat exchanger such that the compressed feed gas is splittable into the first feed stream portion and a second feed stream portion. The second feed stream portion of the compressed feed gas can be feedable to the first heat exchanger to cool the second feed stream portion of the compressed feed gas. The system can also include a fourth column to receive the cooled second feed stream portion of the compressed feed gas from the first heat exchanger to produce a nitrogen-rich vapor stream and an oxygen-enriched stream. The fourth column can be configured to operate at a pressure greater than the pressure at which the HP column is operatable. The fourth column can also be connected to the first heat exchanger so that at least a portion of the nitrogen-rich vapor stream output from the fourth column is passable to the first heat exchanger to heat the nitrogen-rich vapor therein to provide a nitrogen product stream. The fourth column can also be connected to the HP column so that the oxygen-enriched stream output from the fourth column is feedable to the HP column. The HP reboiler-condenser can be positioned so that the HP condensate stream is splittable into the first portion of the HP condensate stream and a second portion of the HP condensate stream so that the second portion of the HP condensate stream is passable to the fourth column at or adjacent a top of the fourth column.

In a sixteenth aspect, the system can include a fourth column reboiler-condenser positioned to form a condensate that is recyclable to the fourth column. The fourth column can be connected to the HP column so that the oxygen-enriched stream output from the fourth column is passed to the fourth column reboiler-condenser to at least partially vaporize the oxygen-enriched stream for feeding it to the HP column.

In a seventeenth aspect, the HP oxygen-enriched stream output from the HP column can be splittable into a first portion and a second portion and the mixing device can be positioned to mix the first mixed nitrogen-oxygen fluid with the second portion of the HP oxygen-enriched stream to form the mixed nitrogen-oxygen fluid before feeding the first mixed nitrogen-oxygen fluid to the AE column reboiler-condenser to provide at least a portion of a refrigeration duty of the AE column reboiler-condenser for the at least partially condensing of the first argon-rich vapor. This can be provided, for example, by having the second portion of the HP oxygen-enriched stream fed to the mixing device for mixing therein. This can also be provided by having the second portion of the HP oxygen-enriched stream mixed with the first mixed nitrogen-oxygen fluid after the first mixed nitrogen-oxygen fluid is output from the mixing device but before it is fed to the second reboiler-condenser.

In an eighteenth aspect, the mixing device can be positioned to mix the LP nitrogen-enriched stream output from the LP column with the first LP oxygen-enriched stream output from the LP column and a portion of the HP oxygen-enriched stream for forming the first mixed nitrogen-oxygen fluid.

In a nineteenth aspect, the system can also include a phase separator positioned to receive the first mixed nitrogen-oxygen fluid output from the AE column reboiler-condenser to form a nitrogen-oxygen vapor and a nitrogen-oxygen liquid that is feedable to the LP column. The phase separator can be positioned and configured so that a second mixed nitrogen-oxygen fluid output from the mixing device is mixable with the nitrogen-oxygen vapor output from the phase separator to form a waste gas stream.

In a twentieth aspect, the system can include a phase separator positioned and configured to receive the first mixed nitrogen-oxygen fluid output from the AE column reboiler-condenser to form a vapor comprising nitrogen feedable to the mixing device and a nitrogen-oxygen liquid that is feedable to the LP column. The mixing device can be positioned and configured to also receive the vapor comprising nitrogen from the phase separator for mixing the vapor comprising nitrogen with the LP nitrogen-enriched vapor output from the LP column and the first LP oxygen-enriched stream output from the LP column to form the first mixed nitrogen-oxygen fluid.

In a twenty-first aspect, the system can be provided such that the mixing device is a single stage mixing device that is configured to form the first mixed nitrogen-oxygen fluid as a liquid and a second mixed nitrogen-oxygen fluid as a vapor.

In a twenty-second aspect, the system can be provided such that the mixing device is a multiple stage column or a mixing column. For instance, the multiple sage column or mixing column can be positioned and configured such that the first LP oxygen-enriched stream is introduced at a top of the multiple stage contacting column or the mixing column and flows downward, the LP nitrogen-enriched stream is introduced at the bottom of the multiple stage contacting column or the mixing column and is flowable upward, the first mixed nitrogen-oxygen fluid is output from a bottom of the multiple stage contacting column or the mixing column as a liquid, and a second mixed nitrogen-oxygen fluid is recoverable from the top of the multiple stage contacting column or the mixing column as a vapor.

In a twenty-second aspect, the system can be provided so that the at least partially condensing of the argon-rich vapor is a complete condensing to form an argon-rich liquid. Alternatively, the at least partially condensing of the argon-rich vapor can be an incomplete condensing to form both an argon-rich liquid and while some argon-rich vapor remains within the output stream of argon-rich fluid.

In a twenty-third aspect, the thirteenth aspect can be combined with one or more of the fourteenth aspect, fifteenth aspect, sixteenth aspect, seventeenth aspect, eighteenth aspect, nineteenth aspect, twentieth aspect, twenty-first aspect, and/or twenty-second aspect. For example, the thirteenth aspect can be combined with all of these aspects, just one more of those aspects, or a combination of these aspects in some embodiments of the twenty-third aspect.

It should be appreciated that different streams of fluid that can be utilized in the above discussed embodiments can include vapor, liquid, or a combination of vapor and liquid. Fluid streams that include vapor can include vapor, or gas.

It should also be appreciated that embodiments of the process and/or the system can use a series of conduits for interconnection of different units so that different streams can be conveyed between different units. Such conduits can include piping, valves, and other conduit elements. The system can also utilize sensors, detectors, and at least one controller to monitor operation of the system and/or provide automated or at least partially automated control of the system. Various different sensors (e.g. temperature sensors, pressure sensors, flow sensors, etc.) can be connected to different conduits or system elements.

Other elements can also be included in embodiments of the system that may be provided to utilize an embodiment of our process. For instance, one or more pumps, compressors, fans, vessels, pre-treatment units, adsorbers, or other units can also be utilized in embodiments of the system. It should be appreciated that embodiments of the system can be structured and configured to utilize at least one embodiment of the process.

Other details, objects, and advantages of our processes utilized to recover fluids (e.g. argon and nitrogen) from air, gas separation plants configured to recover nitrogen and argon from at least one feed gas, air separation plants, air separation systems, systems utilizing multiple columns to recover nitrogen, argon and also optionally oxygen fluids, plants utilizing such systems or processes, and methods of making and using the same will become apparent as the following description of certain exemplary embodiments thereof proceeds.

BRIEF DESCRIPTION OF THE DRAWINGS

Exemplary embodiments of processes utilized to recover fluids (e.g. argon and nitrogen) from air, gas separation plants configured to recover nitrogen and argon from at least one feed gas, air separation plants, air separation systems, systems utilizing multiple columns to recover nitrogen and argon fluids, plants utilizing such systems, and methods of making and using the same are shown in the drawings included herewith. It should be understood that like reference characters used in the drawings may identify like components.

DETAILED DESCRIPTION

Referring to FIGS. 1-5, a plant 1 can include a compression system 10 that can compress a feed gas to output a compressed feed gas stream 11 at a pre-selected feed pressure or at a pressure within a pre-selected feed pressure range. The feed gas that is compressed can be air or a gas stream from a plant process unit that can be fed to the compression system 10. The feed gas that is compressed by the compression system can include argon (Ar) and nitrogen ($N_2$) as well as other constituents (e.g. oxygen ($O_2$), carbon dioxide ($CO_2$), water ($H_2O$), etc.).

The compression system 10 can also include a purification unit for purification of the feed after it is compressed. The purification unit can remove undesired feed constituents that may have undesired boiling points or present other undesired processing difficulties. The purification unit can remove, for example, $CO_2$, carbon monoxide, hydrogen, methane and/or water from the feed, for example.

The compressed feed gas stream 11 output from the compression system 10 can be a purified feed gas stream that has impurities removed from the feed gas so that the impurities are below pre-selected constituent thresholds or are entirely removed from the compressed feed gas before the compressed feed gas stream 11 is passed to a first heat exchanger 20. In some embodiments, the compressed feed gas stream 11 can include nitrogen ($N_2$) within a pre-selected nitrogen concentration range, argon (Ar) within a pre-selected argon concentration range, and $O_2$ within a pre-selected oxygen concentration range. The pre-selected $N_2$ concentration range can be, for example, 75-80 volume percent (vol %) of the feed gas stream 11, the pre-selected argon concentration range can be 0.7-3.1 vol %, and the pre-selected $O_2$ concentration range can be 19-23 vol %, example.

Figure 1:
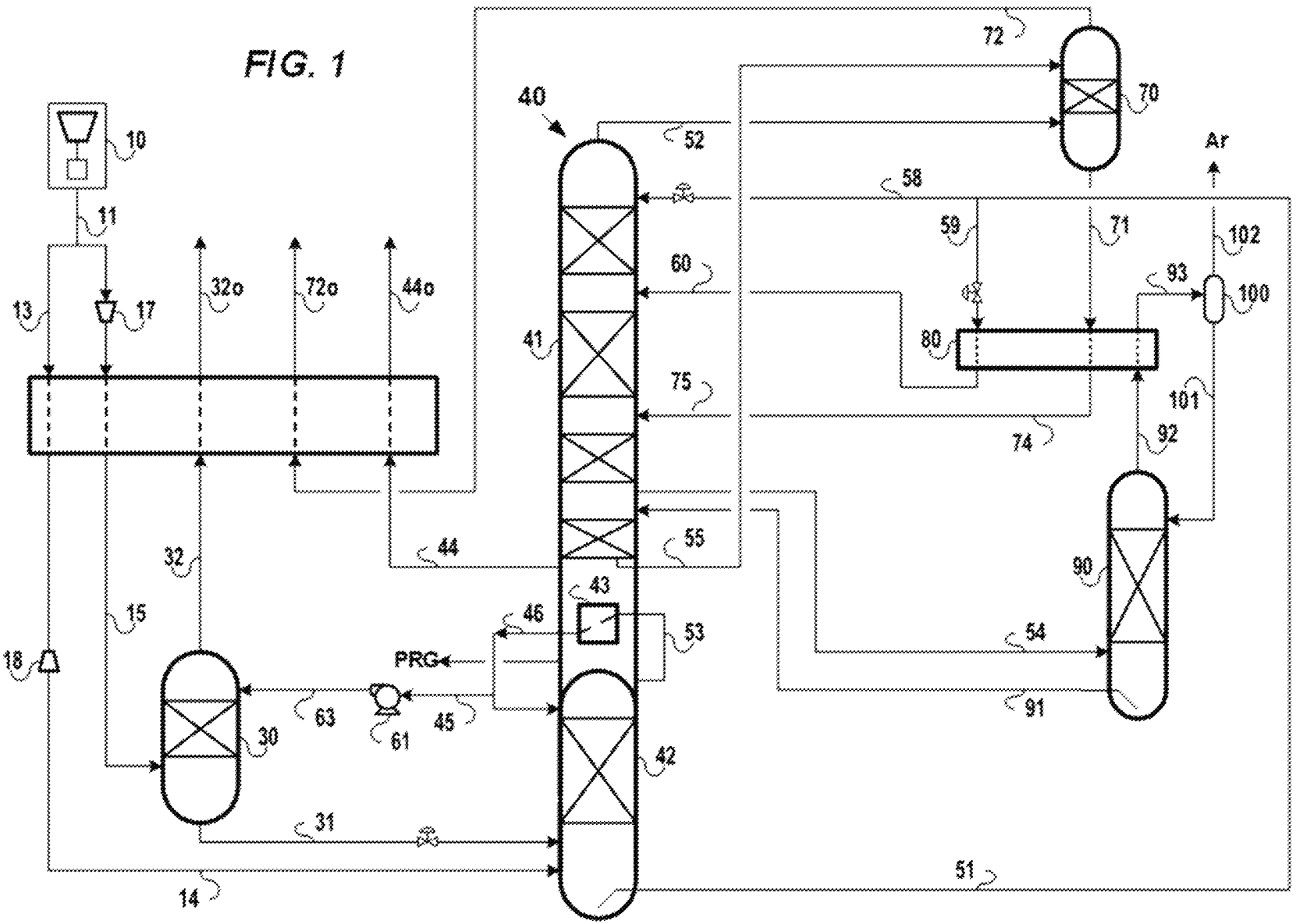
FIG. 1 is a schematic block diagram of a first exemplary embodiment of a plant utilizing a first exemplary embodiment of the air separation process.
Figure 4:
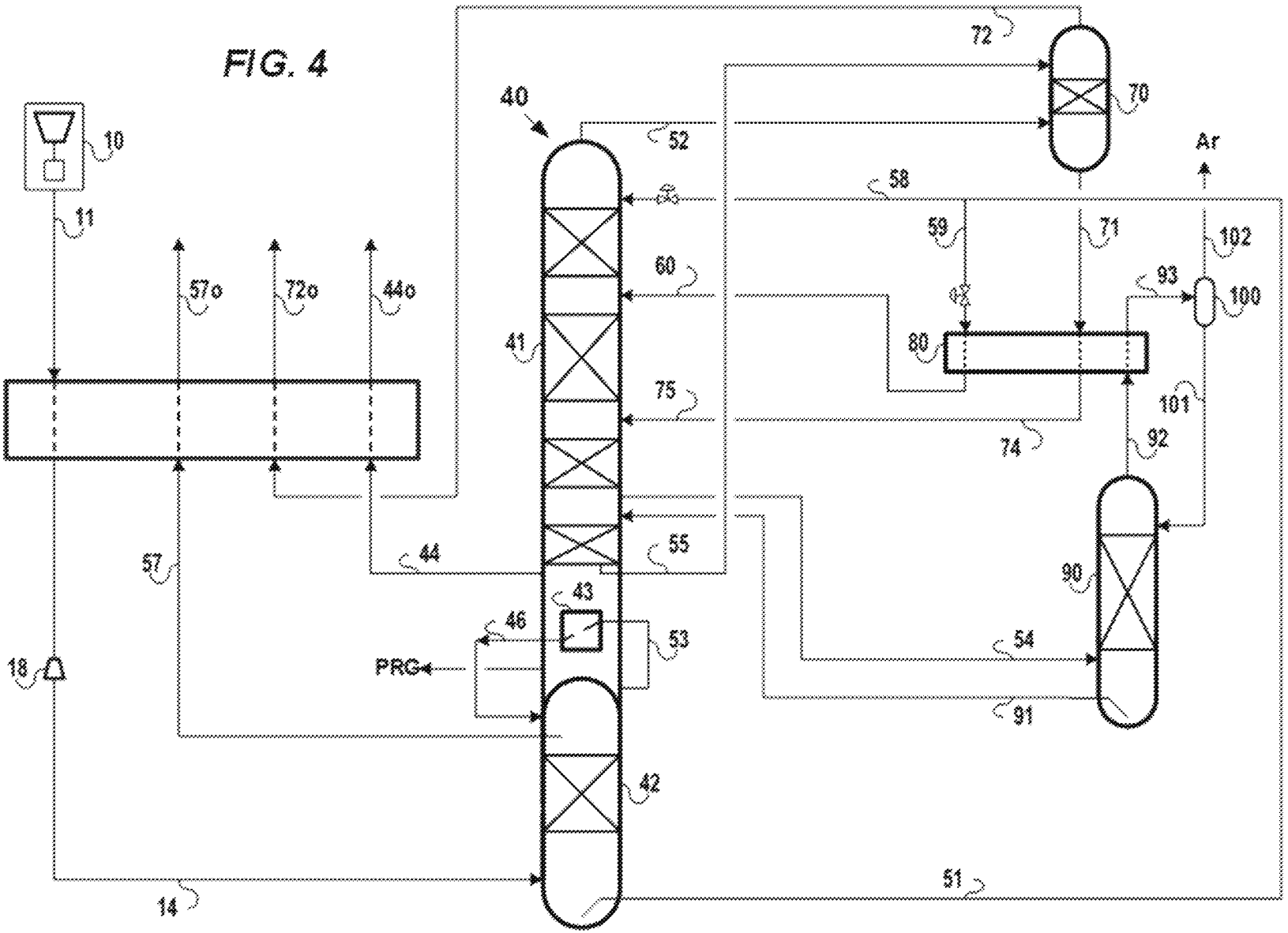
FIG. 4 is a schematic block diagram of a second exemplary embodiment of a plant utilizing a second exemplary embodiment of the air separation process.

The compressed feed gas stream 11 can be fed to the first heat exchanger 20 via at least one heat exchanger feed conduit positioned between the compression system 10 and the first heat exchanger 20. As shown in FIG. 1, the feed gas stream 11 can be split into multiple streams before it is fed to the first heat exchanger 20. A valve or other splitting mechanism can be utilized to split the compressed feed gas stream 11 into multiple streams, for example. Alternatively, the feed gas stream 11 can be fed to the first heat exchanger as a single stream as shown in the embodiment of FIG. 4. In embodiments where the compressed feed gas stream 11 is split or is splittable, the first feed stream portion 13 can be between 30% and 100% of the entire compressed feed gas stream and the second feed stream portion 15 can be up to 70% of the entire compressed feed gas stream 11.

The first heat exchanger 20 can cool the one or more feed gas streams to output the one or more compressed feed gas streams at temperatures within pre-selected temperature ranges for the one or cooled more feed streams. For instance, as can be appreciated from FIG. 1, the compressed feed gas stream 11 can be split into a first feed stream portion 13 and a second feed stream portion 15. The first feed stream portion can undergo cooling in the first heat exchanger 20 and be subsequently output as a first cooled compressed feed stream 14 for being fed to a first column 42 of a multiple column tower 40 that is upstream of a second column 41 of the multiple column tower 40.

The first column 42 can be a high pressure (HP) column 42 of the multiple column tower 40 that is positioned below or otherwise upstream of the second column 41. The second column 41 can be a low pressure (LP) column 41 of the multiple column tower 40 that can operate at a pressure that is lower than the operational pressure of the HP column 42.

The first feed stream portion 13 can undergo expansion via an expander 18 before the first feed stream portion 13 is fed to the HP column 42 as a first cooled compressed feed stream 14. For instance, a turbo-expander can be positioned between the first heat exchanger and the HP column 42 to expand the first feed stream portion 13 to output the first cooled compressed feed stream 14 at an HP feeding pressure within a pre-selected HP feeding pressure range (e.g. 4-20 atm, greater than 5 atm and less than 10 atm, etc.) for feeding the first cooled compressed feed stream portion 14 to the HP column 42. The cooling and optional expansion of the first cooled compressed feed stream 14 can be performed so that this stream is further cooled such that it is at a pre-selected HP column feeding temperature that is within a pre-selected HP column feeding temperature range as well as being at a pressure that is within a pre-selected HP column feeding pressure range.

The second feed stream portion 15 can be cooled in the first heat exchanger 20 and subsequently output from the first heat exchanger 20 and fed to a nitrogen-rich vapor forming column 30. The nitrogen-rich vapor column can be considered a third column in some embodiments of the plant 1. Alternatively, the nitrogen-rich vapor column can be considered a fourth column or a fifth column of the plant 1 where the plant 1 may include other columns in addition to the LP and HP columns 41 and 42 (e.g. an argon-enrichment column 90 discussed below can be considered a third column and the nitrogen-rich vapor column 30 can be considered a fourth column). As yet another alternative, the nitrogen-rich vapor forming column 30 can be considered a first column and the HP column and LP column of the multiple column tower 40 can be considered second and third columns.

The second feed stream portion 15 can undergo additional compression via a supplemental compressor 17 positioned between the first heat exchanger 20 and the compression system 10. This additional pressurization of the second feed stream portion 15 can occur upstream of the nitrogen-rich vapor forming column 30 before the second feed stream portion is fed to the nitrogen-rich vapor forming column 30. For instance, a supplemental compressor 17 can be positioned between the first heat exchanger and the compression system 10 to further compress the second feed stream portion 15 to output the second compressed feed stream 15 at a pre-selected nitrogen-rich vapor forming column pressure that is within a pre-selected nitrogen-rich vapor forming column pressure feeding pressure range (e.g. 5-20 atm, greater than 8 atm and less than 20 atm, etc.) for feeding the second cooled compressed feed stream portion 15 to the nitrogen-rich vapor forming column 30.

The cooling and optional supplemental compression of the second compressed feed stream portion 15 can be performed so that this stream is at a pre-selected nitrogen-rich vapor forming column feeding temperature that is within a pre-selected nitrogen-rich vapor forming column feeding temperature range as well as being at a pressure that is within a pre-selected nitrogen-rich vapor forming column feeding pressure range.

The second compressed feed stream portion 15 can be fed at or adjacent a bottom of the nitrogen-rich vapor forming column 30. The nitrogen-rich vapor forming column 30 can also receive a nitrogen reflux stream 63 that is received from a first reboiler-condenser 43 of the multiple column tower 40. The received nitrogen reflux stream 63 can be a liquid nitrogen stream that is a nitrogen-rich vapor forming column feed stream 45 portion of a reflux stream 46 output from the first reboiler-condenser 43. The reflux stream 46 can include a portion of reflux output from the first reboiler-condenser 43 to be returned to the HP column 42 for further use therein. The nitrogen-rich vapor forming column feed stream 45 of the reflux stream 46 can be the second portion of the HP condensate reflux stream 46 that is not returned to the HP column 42 for use by the nitrogen-rich vapor forming column 30 to form a nitrogen-rich vapor stream 32 to be output as a product stream 320. The nitrogen-rich vapor forming column feed stream 45 of the reflux stream 46 can be fed to a pump 61 to feed the nitrogen reflux stream 63 to or near to the top of the nitrogen-rich vapor forming column 30.

The nitrogen-rich vapor forming column 30 can received the nitrogen reflux stream 63 and the second compressed feed stream portion 15 to form the nitrogen-rich vapor stream 32 as well as an oxygen-enriched stream 31. The oxygen-enriched stream 31 can be a liquid that includes 30-50 vol % oxygen, 1-3 vol % argon, and the balance nitrogen (e.g. 47 vol % to 69 vol % nitrogen).

The formed nitrogen-rich vapor stream 32 can be a gas stream that includes 100 vol % nitrogen to 99 vol % nitrogen or include nitrogen in a range of 100 vol % to 95 vol %. After the nitrogen-rich vapor stream 32 is output from the nitrogen-rich vapor forming column 30, the stream can be passed through the first heat exchanger to warm that stream (and cool the compressed gas feed stream fed to the first heat exchanger 20 via the compression system 10) to output the nitrogen-rich vapor product stream 320.

The oxygen-enriched stream 31 can be output from the nitrogen-rich vapor forming column 30 and fed to the HP column 42 via an oxygen-enriched stream feed conduit positioned between the HP column 42 and the nitrogen-rich vapor forming column 30. The HP column 42 can operate at a pressure that is less than the operational pressure of the nitrogen-rich vapor forming column 30. In such situations, the oxygen-enriched stream feed conduit can include a pressure reduction valve or other type of pressure reduction mechanism to reduce the pressure of the oxygen-enriched stream as may be needed to help feed the oxygen-enriched stream 31 to the HP column 42.

The HP column 42 can be positioned and configured to process the first cooled compressed feed stream 14 (e.g. after it is output from the first heat exchanger 20 and/or after it is output from the expander 18 when the optional expander 18 is utilized) as well as the oxygen-enriched stream 31 output from the nitrogen-rich vapor forming column 30. Of course, in embodiments such as the embodiment of FIG. 4, the HP column may only process the first cooled compressed feed stream 14 (e.g. when the nitrogen-rich vapor forming column 30 is not included).

The HP column 42 can receive the oxygen-enriched stream 31 at or adjacent the bottom, or several stages above the bottom of the HP column and can also receive the first cooled feed stream 14 at or adjacent the bottom of the HP column 42. The HP column 42 can output a HP nitrogen-rich vapor stream 53 and an HP oxygen-enriched stream 51. The HP column 42 can operate a pre-selected HP pressure within a pre-selected HP pressure range (e.g. 4.5 atm to 15 atm, 4.5 atm to 8 atm, etc.). The HP oxygen-enriched stream 51 can be a liquid, a vapor, or a combination of liquid and vapor. The HP oxygen-enriched stream 51 can have an oxygen concentration in a range of 25 vol % to 50 vol %, an argon concentration of 0.5 vol % to 3.5 vol %, and a nitrogen concentration in the range of 46.5 vol % to 74.5 vol %. The HP nitrogen-rich vapor stream 53 can be a stream that includes gas or vapor that has a nitrogen concentration in the range of 100 vol % nitrogen to 98 vol % nitrogen (e.g. 99 vol % nitrogen, 99.5 vol % nitrogen, etc.).

At least a portion of the HP nitrogen-rich vapor stream 53 (e.g. an entirety of the stream or a portion of the stream that is a substantial portion of the stream, etc.) can be fed to a first reboiler-condenser 43. The first reboiler-condenser 43 can be an HP reboiler-condenser 43. The first reboiler condenser 43 can form an HP condensate stream 46. The first portion of the HP condensate stream 46 (e.g. an entirety of this stream or less than an entirety of this stream) can be recycled back to the HP column as reflux. For instance, at least a portion of the HP condensate stream 46 can be output from the first reboiler-condenser 43 back to the HP column 42 as a reflux stream. An entirety of the stream can be provided to the HP column (e.g. as in the embodiment of FIG. 4) or a first portion of this HP condensate stream 46 can be provided back to the HP column and a second portion of the HP condensate stream 46 can be a HP condensate stream 45 that is feedable to the nitrogen-rich vapor forming column 30 as the nitrogen reflux stream 63.

A pump 61 or other type of flow driving mechanism can be connected to a nitrogen reflux stream feeding conduit positioned between the HP column 42 and the nitrogen-rich vapor forming column 30 to help drive the flow of the nitrogen condensate within the second portion of the HP condensate that comprises the HP condensate stream 45 so that it has an increased pressure and is feedable to the nitrogen-rich vapor forming column 30 as the nitrogen reflux stream 63. The nitrogen reflux stream 63 can be a liquid stream and the HP condensate streams 45 and 46 can also be liquid streams. The nitrogen reflux stream 63 can be fed to a top or adjacent to a top of the nitrogen-rich vapor forming column 30 for being processed therein to form a nitrogen-rich vapor stream 32 and the oxygen-enriched stream 31 as discussed herein.

The HP column 42 can be connected to the LP column 41 via an LP column feed conduit through which a first HP oxygen-enriched LP feed stream 58 can be fed to the LP column. The LP column feed conduit through which the first HP oxygen-enriched LP feed stream 58 is passed can include a pressure reduction mechanism (e.g. a valve, an expander, other type of pressure reduction mechanism, etc.) to adjust a pressure of the first HP oxygen-enriched LP feed stream 58.

The first HP oxygen-enriched LP feed stream 58 can include an entirety of the HP oxygen-enriched fluid within the HP oxygen-enriched stream or the HP oxygen-enriched stream 51 can be split so that a first portion of this stream is fed to the LP column as a first HP oxygen-enriched LP feed stream 58 and a second portion of this HP oxygen-enriched stream 51 is fed to a second reboiler-condenser 80 as a second reboiler-condenser HP oxygen-enriched stream 59 before also being subsequently fed to the LP column 41 or other process unit of the plant as a second HP oxygen-enriched stream 60. The second reboiler-condenser HP oxygen-enriched stream 59 can be heated via the second reboiler-condenser 80 to vaporize or at least partially vaporize the liquid within this stream so that the second HP oxygen-enriched stream 60 output from the second reboiler-condenser 80 can be a flow of fluid that is entirely vapor, or is a combination of liquid and vapor.

The second reboiler-condenser 80 can be considered an argon condensing reboiler-condenser of a third column that can be considered an argon-enrichment (AE) column 90. The second reboiler-condenser 80 can also be considered an AE column reboiler-condenser. The second reboiler-condenser 80 can be positioned to provide a flow of reflux to the AE column 90. A second reboiler-condenser feed conduit can be connected between the second reboiler-condenser 80 and the LP column feed conduit to facilitate the splitting of the HP oxygen-enriched stream 51 into the first HP oxygen-enriched LP feed stream 58 and the second reboiler-condenser HP oxygen-enriched stream 59. The second reboiler-condenser feed conduit through which the second reboiler-condenser HP oxygen-enriched stream 59 passes can include a pressure reduction mechanism to adjust a pressure of the second reboiler-condenser HP oxygen-enriched stream 59. The pressure reduction mechanism can include a valve, an expander, or other type of pressure reduction mechanism.

The LP column 41 can be the second column of the multiple column tower 40. The LP column can operate at a pressure that is below the pressure at which the HP column 42 operates. For example, the LP column 41 can operate at a pressure of between 1.1 atm and 4 atm, 1.1 atm and 3 atm, or 1.1 and 2.8 atm.

Reflux for the LP column 41 can be provided at a top of the LP column, adjacent the top of the LP column 41, or at another position of the LP column via a suitable reflux stream that includes a suitable concentration of nitrogen. The reflux can include, for example, the first HP oxygen-enriched LP feed stream 58 or the first HP oxygen-enriched LP feed stream 58 and the second HP oxygen-enriched stream 60 output from the second reboiler-condenser 80. In some implementations, the first HP oxygen-enriched LP feed stream 58 and the second HP oxygen-enriched stream 60 output from the second reboiler-condenser 80 can be merged or combined prior to the streams being fed to the LP column at or adjacent a top of the LP column 41. In other implementations, the streams may not be combined and can be fed at different locations of the LP column 41 (e.g. a top location and an upper location, different upper locations, etc.)

The LP column 41 can be positioned so that rising vapor or column boil-up for the LP column is provided by the first reboiler-condenser 43. Such rising vapor or boil-up can be generated by the first reboiler-condenser 43 and fed to the LP column so that this vapor or boil-up flows in counter-current flow with the liquid fed to the LP column 41 (e.g. the fluid of the first HP oxygen-enriched LP feed stream 58 can be liquid that flows downwardly while the vapor or boil-up flows upwardly in the LP column 41, etc.).

The LP column 41 can be operated to output multiple flows of fluid during operation. For example, the LP column 41 can output at least an LP nitrogen-enriched stream 52, a purge stream PRG, a first LP oxygen-enriched stream 55, a second LP oxygen-enriched stream 44, and an LP argon-enriched stream 54 can be output from the LP column. The LP nitrogen-enriched stream 52 can be a nitrogen-enriched vapor stream that includes nitrogen in a concentration range of 50 vol % to 70 vol % or a range of 50 vol % to 99 vol % nitrogen. The purge stream PRG can be an impurities containing stream that includes enriched, but relatively low, concentrations of xenon, krypton, $CO_2$, methane, and other hydrocarbons with the balance of the purge stream being oxygen (e.g. 99-99.99 vol % oxygen, or at least 97 vol % oxygen to 99.99 vol % oxygen). The concentration of the trace impurities within the purge stream PRG can be highly variable and can depend on a number of factors including the quantity of the flow.

The first LP oxygen-enriched stream 55 can also be considered an oxygen-rich stream. The first LP oxygen-enriched stream 55 can include 0.01 vol % to 3 vol % argon, trace amounts of nitrogen, and the balance oxygen (e.g. 97-99.99 vol % oxygen). The first LP oxygen-enriched stream 55 can be a flow of liquid.

The second LP oxygen-enriched stream 44 can also be considered an oxygen-rich stream. The second LP oxygen-enriched stream 44 can include 0.01 vol % to 3 vol % argon, trace amounts of nitrogen, and the balance oxygen (e.g. 97-99.99 vol % oxygen). The second LP oxygen-enriched stream 44 can be a flow of liquid output from the LP column, can be a flow of vapor, or can be a flow of fluid that includes liquid and vapor.

The LP argon-enriched stream 54 can include 5 vol % to 25 vol % argon, 0 to 500 ppm nitrogen, and the balance oxygen (75 vol % oxygen to 95 vol % oxygen). The LP argon-enriched stream 54 can be a flow of fluid that includes vapor.

The second LP oxygen-enriched stream 44 can be fed to the first heat exchanger 20 to function as a cooling medium therein for cooling the feed gas fed to the heat exchanger 20, which can result in warming of the second LP oxygen-enriched stream 44 for outputting a warmed output stream 440 of the second LP oxygen-enriched stream 44. A LP oxygen-enriched stream feed conduit can be connected between the LP column 41 and the first heat exchanger 20 for feeding this stream to the first heat exchanger 20. The warmed output stream 44*o* of the second LP oxygen-enriched stream 44 can be a waste stream that is emitted to atmosphere, can be used as a regeneration gas in the plant or a facility connected to the plant 1 or can be output as a product gas for storage and subsequent use or sale.

The impurities enriched purge stream PRG can be directed to a storage vessel for storage of the purge stream. Or the impurities enriched purge stream PRG can be directed to another type of device for producing a krypton enriched product stream and/or a xenon enriched product stream, for example.

The first LP oxygen-enriched stream 55 can be output from the LP column 41 and fed to a mixing device 70. A mixing device LP oxygen-enriched feed conduit can be connected between the mixing device 70 and the LP column for the feeding of the LP oxygen-enriched stream 55 to the mixing device 70. For example, the mixing device LP oxygen-enriched feed conduit can extend from adjacent a bottom of the LP column to the top or upper portion of the mixing device 70.

The LP nitrogen-enriched stream 52 can also be output from the LP column 41 and fed to the mixing device 70. A mixing device LP nitrogen-enriched feed conduit can be connected between the mixing device 70 and the LP column 41 for the feeding of the LP nitrogen-enriched stream 52 to the mixing device 70. For example, the mixing device LP nitrogen-enriched feed conduit can extend from adjacent top of the LP column (e.g. at an upper portion of the LP column 41 or at a top of the LP column 41) to the bottom or lower portion of the mixing device 70.

The feeding of the LP nitrogen-enriched stream 52 to the mixing device 70 can include an entirety of the LP nitrogen-enriched stream 52 being fed to the mixing device 70 or only a first portion of this stream being fed to the mixing device while a second portion is split from the LP nitrogen-enriched stream 52 for being mixed with a second mixed nitrogen-oxygen fluid stream 72 output from the mixing device 70 or being fed separately to the first heat exchanger 20 for being output as a separate product stream, a process stream for use in another plant process (e.g. a regeneration stream), or as a waste stream for venting to the atmosphere.

The mixing device 70 can be a single stage mixing column, a multiple stage mixing column, a vapor-liquid phase separator, a mixing-tee, an in-line mixer or other type of mixing device. The mixing device 70 can provide only a single stage of mixing or can alternatively provide multiple stages of mixing. Exemplary mixing device configurations that can be utilized in the plant 1 can also be appreciated from FIGS. 2, 3, and 4.

The first LP oxygen-enriched stream 55 can be fed to an upper portion of the mixing device (e.g. at top of a mixing column or adjacent a top of the mixing column) for flowing downwardly through the mixing device 70. The LP nitrogen-enriched stream 52 can be fed to a lower portion of the mixing device (e.g. at a bottom or adjacent a bottom of a mixing column) for flowing upwardly through the mixing device 70 in counter-current flow with the oxygen-enriched fluid (e.g. liquid) of the first LP oxygen-enriched stream 55 fed to the mixing device for flowing downwardly through the mixing device 70.

The LP nitrogen-enriched stream 52 and the first LP oxygen-enriched stream 55 can be mixed via the mixing device 70 to form a first mixed nitrogen-oxygen fluid stream 71 and a second mixed nitrogen-oxygen fluid stream 72. The first mixed nitrogen-oxygen fluid stream 71 can be entirely liquid or be almost entirely liquid (e.g. be within 2 vol % liquid or within 1 vol % liquid and be a combination of liquid and vapor). The second mixed nitrogen-oxygen fluid stream 72 can be a vapor or a combination of vapor and liquid. The second mixed nitrogen-oxygen fluid stream 72 can be fed to the first heat exchanger 20 to function as a cooling medium therein and be warmed therein and can be output as a warmed mixed nitrogen-oxygen stream 720 that can be conveyed for emission out of the plant as a waste stream, used a regeneration gas for a purification unit of the plant, or transported to another plant unit for use therein. A second mixed nitrogen-oxygen fluid conduit can be connected between the mixing device 70 and the first heat exchanger 20 to feed the second mixed nitrogen-oxygen fluid stream 72 to the first heat exchanger for outputting the warmed mixed nitrogen-oxygen stream 720.

The LP argon-enriched stream 54 can be output from the LP column and fed to the AE column 90. An LP argon-enriched feed conduit can be connected between the LP column 41 and the AE column 90 for feeding the LP argon-enriched stream 54 to the AE column 90. The argon-enriched stream 54 can be fed to a lower portion of the AE column 90 (e.g. at a bottom of the column or adjacent a bottom of the column). LP argon-enriched stream 54 can ascend within the AE column 90 to exit the top of the column or exit adjacent the top of the column as an argon-rich vapor stream 92. The argon-rich vapor stream can have a concentration of argon that is higher than the concentration of argon within the LP argon-enriched stream 54 fed to the AE column 90. For instance, the argon-rich vapor stream 92 can include 100 vol % to 95 vol % argon (e.g. the argon-rich vapor stream 92 can also include 0 vol % to 4 vol % oxygen, 0 vol % to 1 vol % nitrogen, and the balance argon).

The argon-rich vapor stream 92 can be output from the AE column 90 and fed to the second reboiler-condenser 80 via an argon vapor reboiler-condenser feed conduit positioned between the AE column 90 and the second reboiler-condenser 80. The second reboiler-condenser 80 can substantially condense the argon-rich vapor of the argon-rich vapor stream 92 to a liquid (e.g. condense an entirety of the argon-rich vapor to a liquid or condense at least 90% of the vapor to a liquid, condense at least 95% of the vapor to a liquid, etc.).

The first mixed nitrogen-oxygen fluid 71 fed from the mixing device 70 to the second reboiler-condenser 80 can be heated such that the liquid within this fluid is at least partially vaporized to form a first heated mixed nitrogen-oxygen fluid stream 74 to be output from the second reboiler-condenser 80 for feeding to the LP column 41. A mixed nitrogen-oxygen feed conduit can be connected between the second reboiler-condenser and the LP column 41 for feeding this first heated mixed nitrogen-oxygen fluid stream 74 from the second reboiler-condenser to the LP column 41.

In some implementations, the first mixed nitrogen-oxygen fluid 71 can provide an entirety of the refrigeration duty to the second reboiler-condenser 80 for condensing the argon-rich vapor stream 92 for forming an argon-rich fluid stream 93. In such implementations, there may not be any splitting of the HP oxygen-enriched stream 51 so that the entirety of this stream is fed to the LP column 41 as the first HP oxygen-enriched LP feed stream 58.

In other implementations, the refrigeration duty to the second reboiler-condenser 80 may be sufficiently high that a portion of the HP oxygen-enriched stream 51 may also be provided such that this stream can be split to form the second reboiler-condenser HP oxygen-enriched stream 59 for feeding that stream to the second reboiler-condenser 80 to provide additional refrigeration duty for the second reboiler-condenser 80. The plant 1 can be operated so that this splitting is adjustable (e.g. formation of the second reboiler-condenser HP oxygen-enriched stream 59 can be adjustable so that this stream is formed and then ceased being formed in different cycles of operation depending on operational conditions of the plant). Such adjustable splitting can be provided by an adjustable valve, for example. The adjustable valve can be moved between a non-splitting position that prevents splitting of the flow of the HP oxygen-enriched stream 51 and one or more splitting positions for splitting the flow of the HP oxygen-enriched stream 51 to form the second reboiler-condenser HP oxygen-enriched stream 59 for feeding that stream to the second reboiler-condenser 80.

The condensed argon-rich fluid of the argon-rich vapor stream 92 fed to the second reboiler-condenser 80 can be output from the second reboiler-condenser 80 as an argon-rich fluid stream 93 for feeding to a separator 100 via a condensed argon-rich fluid conduit connected between the separator 100 and the second reboiler-condenser 80. The separator 100 can be a phase separator or other type of separator that is operated to form an argon vapor product stream 102 that is output from the separator 100 and a liquid argon reflux stream 101. In some implementations, the flow of the argon vapor product stream 102 can be a flow that is 2 vol % to 6 vol % of the flow of the LP enriched argon stream 54 fed to the AE column 90. The argon vapor product stream 102 can be passed to one or more additional unit operations for further processing (e.g. fluid condensation and/or storage).

Alternatively, the condensed argon-rich fluid of the argon-rich vapor stream 92 fed to the second reboiler-condenser 80 can be output from the second reboiler-condenser 80 as an argon-rich fluid stream 93 which is totally liquid. In such a case separator 100 in not necessary and the argon product stream would be split off from argon-rich fluid stream 93, the remaining flow would be liquid argon reflux stream 101.

The liquid argon reflux stream 101 can be output from the separator 100 or as a fluid portion of argon-rich fluid stream 93 for feeding as reflux to the AE column 90 via an AE column reflux conduit connected between the AE column 90 and the separator 100. The AE column 90 can receive the liquid argon reflux stream 101 adjacent an upper portion of the AE column 90 (e.g. at its top or near its top) so that the liquid argon reflux is passed downwardly through the AE column in counter-current flow with the uprising argon vapor of the argon-enriched stream 54 fed to the AE column 90.

The AE column 90 can output an argon depleted fluid stream 91 for feeding to the LP column 41 via an argon depleted fluid feed conduit connected between the LP column 41 and the AE column 90. The argon depleted fluid stream 91 can be output at a lower portion of the AE column (e.g. at its bottom or adjacent its bottom) for feeding to a location that is below the location at which the LP argon-enriched stream 54 is output from the LP column 41 or can be located at a position at or near the position at which the LP argon-enriched stream 54 is output from the LP column 41.

Figure 2:
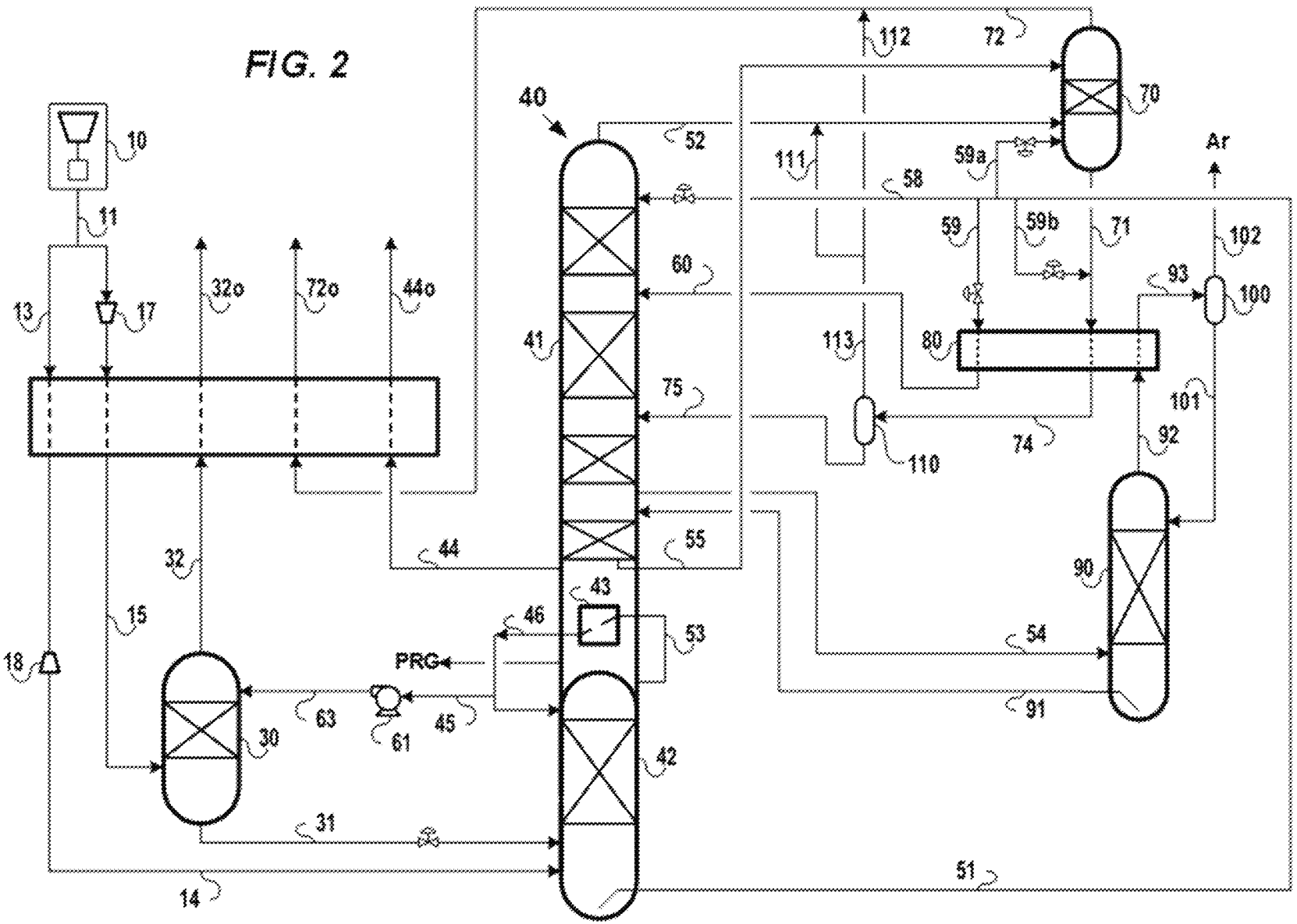
FIG. 2 is a schematic block diagram of another exemplary embodiment of a plant utilizing the first exemplary embodiment of the air separation process that includes alternative and or additional features.

With reference to FIG. 2, in some embodiments, the flow of first mixed nitrogen-oxygen fluid 71 may be supplemented prior to being fed to the second reboiler-condenser 80 for forming the first heated mixed nitrogen-oxygen fluid stream 74. In one embodiment a fraction of HP oxygen enriched stream 51 may be split off as oxygen enriched portion **59*b* and combined with first mixed nitrogen-oxygen fluid stream 71 prior to it being fed to the second reboiler-condenser 80**.

It should be appreciated that the mixing of an oxygen enriched portion **59*b* with the first mixed nitrogen-oxygen fluid 71 can result in the first mixed nitrogen-oxygen fluid 71 that is fed to the second reboiler-condenser 80 having a higher oxygen content. The first mixed nitrogen-oxygen fluid 71 output from the mixing device 70 is fed to the second reboiler-condenser 80 when it is mixed with the oxygen enriched portion 59*b* as well as when it is not mixed with that portion of the HP oxygen enriched stream 51 to provide at least a portion of a refrigeration duty of the second column reboiler-condenser 80** (which can also be referred to as the AE column reboiler-condenser as noted herein) for at least partially condensing the first argon-rich vapor.

In another embodiment a fraction of HP oxygen enriched stream 51 may be split off as oxygen enriched portion 59*a*. Oxygen enriched portion 59*a* may be fed to mixing device 70 and be incorporated into first mixed nitrogen-oxygen fluid stream 71 prior to being fed to the second reboiler-condenser 80.

The splitting of HP oxygen enriched stream 51 to form second reboiler-condenser HP oxygen-enriched stream 59, and alternatively, oxygen enriched portions 59*a*, 59*b* can be adjustable such that the splitting occurs in some cycles of operation of the plant 1 and does not occur in other operation cycles of the plant. An adjustable valve can be controlled to provide adjustment between splitting and non-splitting operations of the different optional flows. In some embodiments, the splitting of the HP oxygen enriched stream 51 can be performed to only form the first HP oxygen-enriched LP feed stream 58 and a first oxygen enriched portion 59*a* of the HP oxygen enriched stream 51 to feed to the mixing device 70 so it can mix with the other streams fed to the mixing device for formation of the first and second mixed nitrogen-oxygen fluid stream streams 71 and 72.

In some implementations, the splitting of the HP oxygen enriched stream 51 can be performed to form the first oxygen enriched portion 59*a* of the HP oxygen enriched stream 51 for feeding to the mixing device 70, the second oxygen enriched portion 59*b* of the HP oxygen enriched stream 51 the first HP oxygen-enriched LP feed stream 58 for mixing with the first nitrogen-oxygen fluid stream 71 output from the mixing device 70, and/or the second reboiler-condenser HP oxygen-enriched stream 59 for feeding through the second reboiler-condenser before the stream is fed to the LP column 41 so that the second HP oxygen-enriched stream 60 output from the second reboiler-condenser 80 can be fed to the LP column 41.

It should be appreciated that these various streams 58, 59, 59*a*, and 59*b* can each be considered different portions of the HP oxygen enriched stream 51 that is split to form those streams. Each stream can be considered a first portion, second portion, third portion, and/or fourth portion of the HP oxygen enriched stream 51, for example.

The mixing of the oxygen enriched portion 59*b* with the first mixed nitrogen-oxygen fluid 71 can occur in a mixing device fluidly connected between the second reboiler-condenser 80 and the mixing device 70, which is represented in FIG. 2 by the arrow of oxygen enriched portion 59*b* meeting a flow line for the first mixed nitrogen-oxygen fluid 71. Such a mixing device can be a particular conduit portion or vessel fluidly connected to a conduit that is sized and configured to receive the oxygen enriched portion 59*b* for mixing it with the first mixed nitrogen-oxygen fluid 71 passing through the conduit or vessel as it flows toward the second reboiler-condenser, for example.

As discussed above, in implementations or cycle operations where oxygen enriched portion 59*a* and/or oxygen enriched portion 59*b* are employed, the second reboiler-condenser HP oxygen-enriched stream 59 may not be formed to feed to the second reboiler-condenser 80 and there will not be a second HP oxygen-enriched stream 60 output from the second reboiler-condenser 80 for feeding to the LP column. Only the first heated mixed nitrogen-oxygen fluid stream 74 may be output from the second reboiler-condenser 80 for being fed to the LP column 41 in such implementations or operational cycles.

FIG. 2 also illustrates a phase separator 110 that can be included in embodiments of the plant 1 so that vapor of the first heated mixed nitrogen-oxygen fluid stream 74 can be separated from liquid of the first heated mixed nitrogen-oxygen fluid stream 74 so that the liquid of the first heated mixed nitrogen-oxygen fluid stream 74 is output from the phase separator 110 and fed to the LP column 41 as the first mixed nitrogen-oxygen LP column feed stream 75 as a nitrogen-oxygen liquid stream. The phase separator 110 can be included in the embodiments of FIG. 1, 3 or 4, as well as other embodiments, for example. The vapor output from the phase separator 110 can be output as a second nitrogen-enriched stream 113. The second nitrogen-enriched stream 113 can be a nitrogen-oxygen vapor stream or can be considered a stream of a vapor comprising nitrogen.

In one embodiment, the second nitrogen-enriched stream 113 can be output from the phase separator 110 and at least a portion 112 of this stream output from the phase separator 110 can be mixed with the second mixed nitrogen-oxygen fluid stream 72 to be fed to the first heat exchanger 20 for providing a cooling medium for that heat exchanger that subsequently outputs the mixed stream as warmed mixed nitrogen-oxygen stream 720.

Alternatively (or in combination), the second nitrogen-enriched stream 113 can be output from the phase separator 110 and at least a portion 111 of this stream can be mixed with the LP nitrogen-enriched stream 52 for feeding to the mixing device 70. In embodiments where the second nitrogen-enriched stream 113 is split into multiple portions 111 and 112, the portion 111 can be considered a first portion of the second nitrogen-enriched stream 113 output from the phase separator 110 and the portion 112 of this stream output from the phase separator 110 that can be mixed with the second mixed nitrogen-oxygen fluid stream 72 can be considered a second portion of the second nitrogen-enriched stream 113.

Operation in this manner (e.g. use of the second nitrogen-enriched stream as portion 111, portion 112, or both portions 111 and 112 for mixing with other streams) can reduce vapor traffic in the upper region of the LP column 41 without reducing the vapor flow to the mixing device 70.

Figure 3:
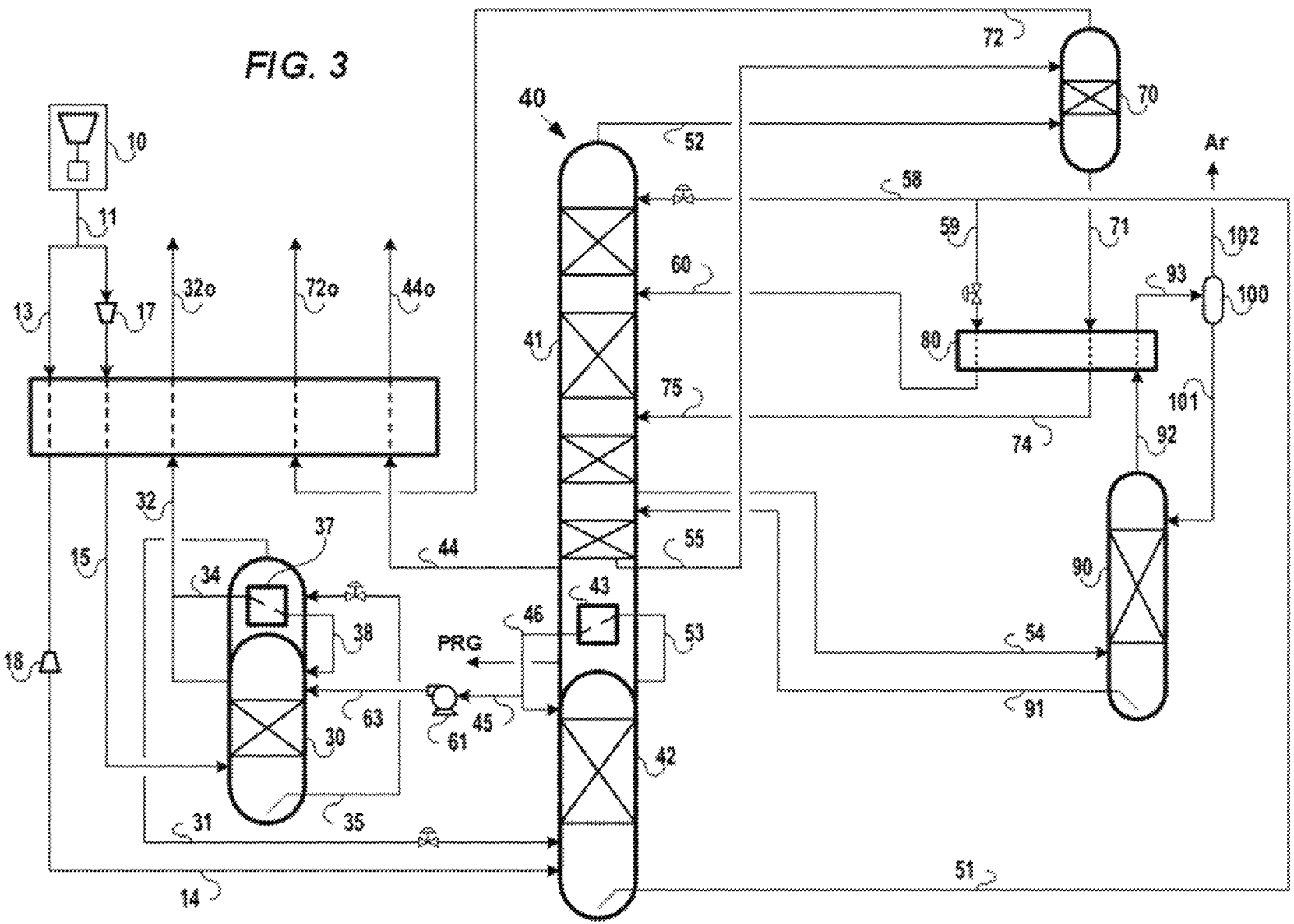
FIG. 3 is a schematic block diagram of a third exemplary embodiment of a plant utilizing the first exemplary embodiment of the air separation process that includes modifications to the nitrogen rich vapor forming column.

As may be appreciated from FIGS. 1 and 3, the nitrogen-rich vapor forming column 30 can be configured as a relatively simple column that does not utilize a condenser, as shown in FIGS. 1-2 or can be a more complex column that utilizes a reboiler-condenser as shown in FIG. 3. For either type of configuration, the column can be a single stage column or a multiple stage column.

As shown in FIG. 3, in embodiments of the nitrogen-rich vapor forming column 30 that utilize a reboiler-condenser 37, the reboiler-condenser can be considered a third reboiler-condenser, a fourth column reboiler-condenser, or a reboiler-condenser of the nitrogen-rich vapor forming column 30. In implementations that may utilize such an arrangement for the nitrogen-rich vapor forming column 30, the nitrogen-rich vapor stream 32 can be split so a first portion of this stream is fed to the first heat exchanger 20 to output the product stream 320 and a second portion 34 of the nitrogen-rich vapor stream is fed to the third reboiler-condenser 37. This second portion 34 of the nitrogen-rich vapor stream can be condensed by the third reboiler-condenser and output as nitrogen-rich condensate stream 38 that is recycled back to the nitrogen-rich vapor forming column 30 as reflux for the column. A third reboiler-condenser enriched oxygen stream 35 is output from the nitrogen-rich vapor forming column 30 and fed to the third reboiler-condenser 37 as a third reboiler-condenser cooling medium feed and is subsequently vaporized or at least partially vaporized when passed through the third reboiler-condenser 37 for condensing the second portion 34 of the nitrogen-rich vapor stream fed to the third reboiler-condenser 37. The third reboiler-condenser enriched oxygen stream 35 can undergo a pressure reduction via an expander, valve or other type of pressure reduction mechanism prior to the stream being fed to the third reboiler-condenser 37.

The vaporized oxygen-enriched oxygen is output from the third reboiler-condenser 37 of the nitrogen-rich vapor forming column 30 can be the oxygen-enriched stream 31 that is subsequently fed to the HP column 42. In implementations that may utilize the third reboiler-condenser 37, a higher recovery of nitrogen within the product stream 320 can be provided. However, this may result in a lower recovery of argon in the argon vapor product stream 102.

It should be understood that the embodiments of FIGS. 1-2 can also utilize a nitrogen-rich vapor forming column 30 that includes or uses a reboiler-condenser 37. In such embodiments, the same flow paths concerning use of the reboiler-condenser 37 as discussed above can be provided and/or used in such implementations.

The above discussed embodiments of FIGS. 1-3 can utilize a multiple column process that includes the HP column 42, LP column 41, and nitrogen-rich vapor forming column 30 as well as other elements. The argon recovery benefits of utilization of the mixing device 70 can also be obtained without use of the nitrogen-rich vapor forming column 30. An example of an embodiment that does not use the nitrogen-rich vapor forming column 30 is shown in FIG. 4, for example. In the embodiment of FIG. 4, the splitting of the feed gas to form the second feed stream portion 15 may not be needed or used, the nitrogen-rich vapor forming column 30 can be omitted, the formation of the nitrogen-rich vapor stream 32 and product stream 320 can be omitted, there is no formation of the oxygen-enriched stream 31 for feeding to the HP column 42. Nor is the pump 61 or use of the nitrogen-rich vapor forming column feed stream 45 portion of the reflux stream 46 output from the first reboiler-condenser 43 utilized.

In the embodiment of FIG. 4, the compressed feed gas 11 can be fed to the first heat exchanger 20 for being cooled therein and subsequently fed to the HP column 42 as the cooled compressed first feed stream portion 14. This stream can undergo pressure reduction via an expander 18 or other type of pressure reduction mechanism before being fed to the HP column 42 as well.

The HP column 42 can be configured to process the cooled first feed stream portion 14 fed therein to form the HP oxygen-enriched stream 51, the HP nitrogen-rich vapor stream 53, and an HP nitrogen product vapor stream 57, which can be output from the HP column 42 and fed to the first heat exchanger 20 to undergo warming before being output as a product stream 570 for subsequent use or storage similar to the product stream 320 (of FIG. 1, for example). The HP nitrogen product vapor stream 57 can include 100 vol % nitrogen to 98 vol % nitrogen or be 100 vol % nitrogen to 99 vol % nitrogen. The HP oxygen-enriched stream 51 can include 30 vol % oxygen to 50 vol % oxygen, 1 vol % argon to 3 vol % argon, and have the balance be nitrogen (e.g. 47 vol % nitrogen to 69 vol % nitrogen).

At least a portion of the HP nitrogen-rich vapor stream 53 can be fed to the first reboiler-condenser 43 to form HP condensate included in the reflux stream 46 that can be recycled back to the HP column 42 as discussed above.

It should be appreciated that the LP column 41 can process one or more streams output from the HP column 42 and/or first reboiler-condenser 43 as discussed above. The mixing device 70, second reboiler-condenser 80, AE column, separator 100 and phase separator 110 can also be utilized as discussed above for the embodiment of FIG. 4. It should also be appreciated that the phase separator 110 can be utilized and included in the embodiments of FIGS. 1 and 3 as noted above.

It should be appreciated that the plant 1 can be configured to utilize an air separation process that can be configured to facilitate recovery of at least one nitrogen fluid as well as at least one argon fluid flow. Embodiments can also recover at least one other fluid (e.g. at least one oxygen fluid flow) as well. Embodiments of the plant 1 can utilize a controller, such as the exemplary controller shown in FIG. 5, to help monitor and/or control operations of the plant 1. The plant 1 can be configured as an air separation system or a cryogenic air separation system that is configured as a standalone facility or is incorporated in a larger facility having other plant facilities (e.g. a manufacturing plant for making semiconductor chips, an industrial plant for making goods, a mineral refining facility, etc.).

It should be appreciated that embodiments of the plant 1 including the embodiments of FIGS. 1 and 4 can be configured as an air separation plant or other type of plant in which it is desired to recover nitrogen and/or argon from a feed gas (e.g. air, waste emissions from a plant, etc.). The plant. can be configured to include process control elements positioned and configured to monitor and control operations (e.g. temperature and pressure sensors, flow sensors, an automated process control system having at least one work station that includes a processor, non-transitory memory and at least one transceiver for communications with the sensor elements, valves, and controllers for providing a user interface for an automated process control system that may be run at the work station and/or another computer device of the plant, etc.).

Figure 5:
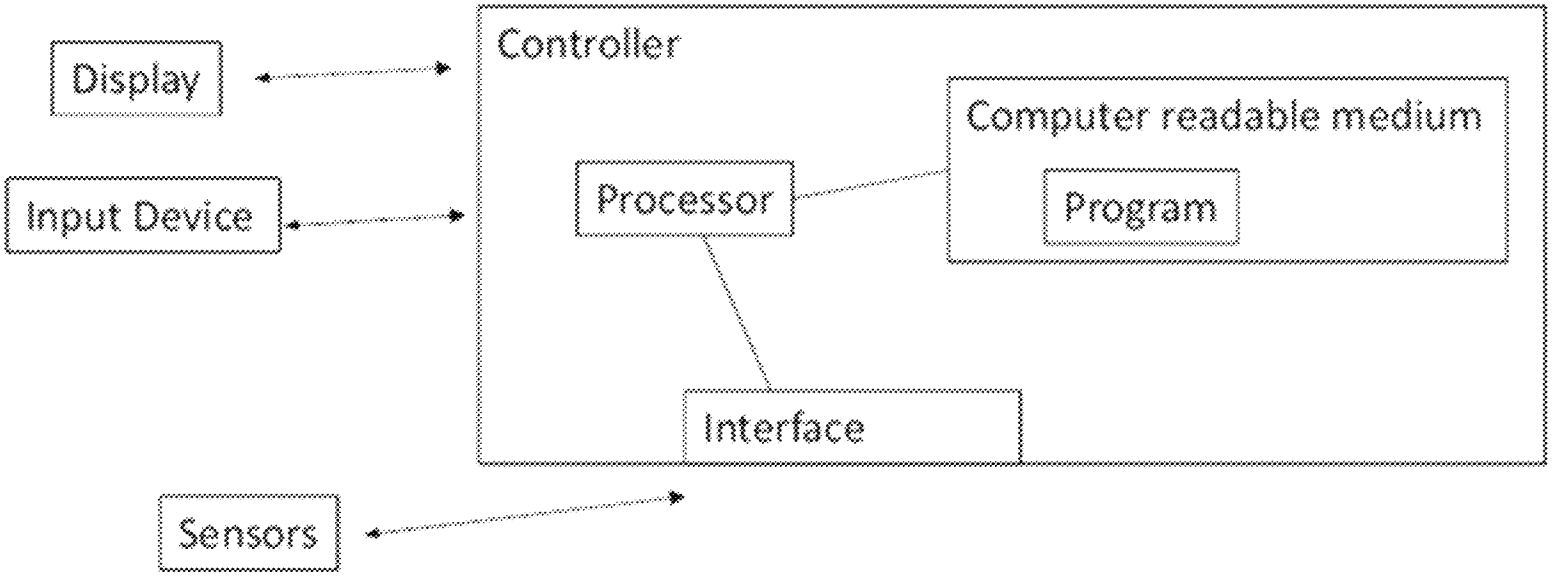
FIG. 5 is a schematic block diagram of an exemplary controller that can be utilized in the embodiments of the plants shown in FIGS. 1-4.

An example of such a process control system that may be included is shown in FIG. 5, for example. The process control system can include a controller having a processor that is connected to a computer readable medium and at least one interface. The computer readable medium can have a program stored thereon that defines a process control method implemented by the controller when the processor runs the program. The controller can receive data from sensors (e.g. temperature sensors, flow sensors, pressure sensors, etc.) and utilize that data when implementing the method defined by the program. The controller can be communicatively connected to at least one input device and at least one output device as well. The at least one input device can be, for example, a workstation, a keyboard, a pointer device, or other type of input device. The output device can include a touch screen, a screen, a monitor, a printer, or other type of output device.

During confidential studies and testing, we have discovered that incorporating the mixing device 70 into an air separation process that may not produce significant quantities of nitrogen from the LP column 41 can result in a greater fractional increase in the recovery of argon. In some situations, it was found that the relative argon recovery could be substantially increased.

In the studies conducted, we learned that argon recovery may be dramatically improved when vapor from the first heated mixed nitrogen-oxygen fluid stream 74 was directed back to the mixing device 70. Furthermore, argon recovery improvements were also observed when the entirety, of the first heated mixed nitrogen-oxygen fluid stream 71 is directed back to the LP column 41 as the first mixed nitrogen-oxygen LP column feed stream 75 (and subsequently able to be recycled back to the mixing device 70).

Upon review of the findings, we discovered that returning the vapor portion of the first heated mixed nitrogen-oxygen fluid stream 74 to the mixing device 70 can allow argon that was contained in that vapor to be partially recovered within the mixing device 70. When returning the vapor portion back to the LP column 41, the rising vapor contacted the liquid descending in the LP column 41, which also extracted argon from the vapor.

We believe that both these factors contribute to driving the argon down the LP column 41 and allowing the argon to flow into the AE column 90 and thereby increase overall argon recovery.

Example 1

We performed fundamental thermodynamic simulations to evaluate argon recovery and power consumption for the embodiment of FIG. 1. In these simulations, the AE column 90 operated at a top pressure of 1.05 atmospheres (atm.), the LP column 41 operated at a top pressure of 1.31 atm, the HP column 42 operated at a top pressure of 5.2 atm, the nitrogen-rich vapor forming column 30 operated at a top pressure of 11.3 atm and the mixing device 70 was a column that, when applied in the simulations, operated at a top pressure of 1.37 atm.

The results are highlighted in Table 1:

TABLE 1

Simulation results for an embodiment based on FIG. 1

| | Units | Results |
|---|---|---|
| Nitrogen-rich vapor stream 32 | | |
| Flow | $nm^3/hr$ | 55000 |
| Pressure | atm | 10 |
| Recovery | % | 42.1 |
| Argon vapor product stream 102 | | |
| Flow | $nm^3/hr$ | 717 |
| Recovery | % | 59.2 |
| Power Use | kW | 14183 |
| Relative Argon Production | | 1.41 |
| Relative Power | | 1.00 |

In the above Table 1, the argon production and power consumption were normalized to a prior art process. The argon production from the simulation showed a 41% recovery improvement without any change in power consumption.

Example 2

We also performed fundamental simulations to evaluate argon recovery and power consumption for the following embodiment of FIG. 3. For these simulations, the AE column 90 operated at a top pressure of 1.05 atmospheres (atm.), the LP column 41 operated at a top pressure of 1.31 atm, the HP column 42 operated at a top pressure of 5.2 atm, the nitrogen-rich vapor forming column 30 operated at a top pressure of 11.3 atm and the mixing device 70 was a mixing column that, when applied, operated at a top pressure of 1.37 atm.

The results from this simulation work are highlighted in Table 2:

TABLE 2

Simulation results foran embodiment based on FIG. 3

| | Units | Results |
|---|---|---|
| Nitrogen-rich vapor stream 32 | | |
| Flow | $nm^3/hr$ | 55000 |
| Pressure | atm | 10 |
| Recovery | % | 45.4 |
| Argon vapor product stream 102 | | |
| Flow | $nm^3/hr$ | 652 |
| Recovery | % | 58 |
| Power Use | kW | 13605 |
| Relative Argon Production | | 1.28 |
| Relative Power | | 0.96 |

In the above Table 2, the argon production and power consumption were normalized to a prior art process. The argon production from the simulation showed a 28% recovery improvement with a 4% reduction in power usage.

The simulations we performed established that embodiments of our process and apparatus can provide significantly higher argon recovery while also permitting power consumption to be approximately the same or be reduced. These are surprising and substantial results. Especially given the significant improvement in argon recovery that can be obtained.

It should be appreciated that modifications to the embodiments explicitly shown and discussed herein can be made to meet a particular set of design objectives or a particular set of design criteria. For instance, the arrangement of valves, piping, and other conduit elements (e.g. conduit connection mechanisms, tubing, seals, etc.) for interconnecting different units of the plant for fluid communication of the flows of fluid between different units can be arranged to meet a particular plant layout design that accounts for available area of the plant, sized equipment of the plant, and other design considerations. For instance, the size of each column, number of stages each column has, the size and arrangement of each reboiler-condenser, and the size and configuration of any heat exchanger, conduits, expanders, pumps, or compressors can be modified to meet a particular set of design criteria. As another example, the flow rate, pressure, and temperature of the fluid passed through one or more heat exchangers as well as passed through other plant elements can vary to account for different plant design configurations and other design criteria. As yet another example, the number of plant units and how they are arranged can be adjusted to meet a particular set of design criteria. As yet another example, the material composition for the different structural components of the units of the plant and the plant can be any type of suitable materials as may be needed to meet a particular set of design criteria.

As another example, it is contemplated that a particular feature described, either individually or as part of an embodiment, can be combined with other individually described features, or parts of other embodiments. The elements and acts of the various embodiments described herein can therefore be combined to provide further embodiments. Thus, while certain exemplary embodiments of the processes utilized to recover fluids (e.g. argon and/or nitrogen) from air, gas separation plants configured to recover nitrogen and/or argon from at least one feed gas, air separation plants, air separation systems, systems utilizing multiple columns to recover nitrogen and argon, plants utilizing such systems or processes, and methods of making and using the same have been shown and described above, it is to be distinctly understood that the invention is not limited thereto but may be otherwise variously embodied and practiced within the scope of the following claims.

What is claimed is:

1. A process for separation of a feed gas comprising oxygen, nitrogen, and argon, the process comprising:

compressing a feed gas via a compression system of a separation system having at least a first column and a second column, the first column being a high pressure (HP) column operating at a pressure that is higher than the second column, the second column being a low pressure (LP) column operating at a pressure that is lower than the first column;

feeding a first feed stream portion of the compressed feed gas to a first heat exchanger to cool the first feed stream portion of the compressed feed gas;

feeding the cooled first feed stream portion of the compressed feed gas to the HP column to produce an HP nitrogen-rich vapor stream and an HP oxygen-enriched stream;

condensing a first portion of the HP nitrogen-rich vapor stream via an HP reboiler-condenser to form an HP condensate stream so that a first portion of the HP condensate stream is recyclable to the HP column;

outputting at least LP nitrogen-enriched stream, a first LP oxygen-enriched stream, and an LP argon-enriched stream from the LP column, the first LP oxygen-enriched stream having an oxygen content of at least 97 mol % oxygen;

feeding the LP argon-enriched stream to a third column to form an argon-rich vapor and an argon-depleted liquid, the third column being an argon-enrichment (AE) column;

feeding the formed argon-rich vapor to an AE column reboiler-condenser;

feeding the argon-depleted liquid to the LP column;

at least partially condensing the argon-rich vapor output from the AE column via the AE column reboiler-condenser;

mixing the LP nitrogen-enriched stream output from the LP column with the first LP oxygen-enriched stream output from the LP column to form a first mixed nitrogen-oxygen fluid to feed to the AE column reboiler-condenser where it is at least partially vaporized to provide at least a portion of a refrigeration duty of the AE column reboiler-condenser for at least partially condensing the first argon-rich vapor; and feeding a first portion of the at least partially vaporized first mixed nitrogen-oxygen fluid to the LP column.

2. The process of claim 1, the process also comprising:

splitting the compressed feed gas into the first feed stream portion and a second feed stream portion;

feeding the second feed stream portion of the compressed feed gas to the first heat exchanger to cool the second feed stream portion of the compressed feed gas;

feeding the cooled second feed stream portion of the compressed feed gas to a fourth column to produce a nitrogen-rich vapor stream and an oxygen-enriched stream, the fourth column operating at a pressure that is greater than the pressure at which the HP column operates;

warming at least a portion of the nitrogen-rich vapor stream output from the fourth column in the first heat exchanger to provide a nitrogen product stream;

feeding the oxygen-enriched stream output from the fourth column to the HP column;

splitting the HP condensate stream into the first portion of the HP condensate stream and a second portion of the HP condensate stream; and feeding the second portion of the HP condensate stream to the fourth column at or adjacent a top of the fourth column.

3. The process of claim 2, the process also comprising:

splitting the nitrogen-rich vapor formed via the fourth column into a first portion of the nitrogen-rich vapor that is output from the fourth column and second portion of the nitrogen-rich vapor that is output from the fourth column;

warming the first portion of the nitrogen-rich vapor output from the fourth column in the first heat exchanger to provide the nitrogen product stream;

condensing the second portion of the nitrogen-rich vapor via a fourth column reboiler-condenser to form a condensate that is recyclable to the fourth column; and wherein the feeding of the oxygen-enriched stream output from the fourth column to the HP column comprises:

passing the oxygen-enriched stream output from the fourth column to the fourth column reboiler-condenser to at least partially vaporize the oxygen-enriched stream for feeding it to the HP column.

4. The process of claim 1, comprising:

splitting the HP oxygen-enriched stream output from the HP column into a first portion and a second portion;

mixing the first mixed nitrogen-oxygen fluid with the second portion of the HP oxygen-enriched stream for feeding the first mixed nitrogen-oxygen fluid to the AE column reboiler-condenser to provide at least a portion of a refrigeration duty of the AE column reboiler-condenser for the at least partially condensing of the first argon-rich stream.

5. The process of claim 1, wherein:

the mixing of the LP nitrogen-enriched stream output from the LP column with the first LP oxygen-enriched stream output from the LP column to form the first mixed nitrogen-oxygen fluid to feed to the AE column reboiler-condenser includes mixing the LP nitrogen-enriched stream output from the LP column with the first LP oxygen-enriched stream output from the LP column and a portion of the HP oxygen-enriched stream for forming the first mixed nitrogen-oxygen fluid.

6. The process of claim 1, comprising:

passing the first mixed nitrogen-oxygen fluid output from the AE column reboiler-condenser to a phase separator to form a nitrogen-oxygen vapor and a nitrogen-oxygen liquid;

feeding the nitrogen-oxygen liquid to the LP column; and mixing the nitrogen-oxygen vapor with a second mixed nitrogen-oxygen fluid output from a mixing device that also outputs the first mixed nitrogen-oxygen fluid.

7. The process of claim 1, comprising:

passing the first mixed nitrogen-oxygen fluid output from the AE column reboiler-condenser to a phase separator to form a vapor comprising nitrogen and a nitrogen-oxygen liquid;

feeding the nitrogen-oxygen liquid output from the phase separator to the LP column; and wherein the mixing of the LP nitrogen-enriched stream output from the LP column with the first LP oxygen-enriched stream output from the LP column to form the first mixed nitrogen-oxygen fluid includes:

mixing the vapor comprising nitrogen output from the phase separator with the LP nitrogen-enriched stream output from the LP column and the first LP oxygen-enriched stream output from the LP column to form the first mixed nitrogen-oxygen fluid and/or a second mixed nitrogen-oxygen fluid.

8. The process of claim 1, wherein the mixing of the LP nitrogen-enriched stream output from the LP column with the first LP oxygen-enriched stream output from the LP column is performed in a single stage mixing device that forms the first mixed nitrogen-oxygen fluid as a liquid and a second mixed nitrogen-oxygen fluid as a vapor.

9. The process of claim 1, wherein:

the mixing the LP nitrogen-enriched stream output from the LP column with the first LP oxygen-enriched stream output from the LP column is performed in a multiple stage contacting column or a mixing column such that:

the first LP oxygen-enriched stream is introduced at a top of the multiple stage contacting column or the mixing column and flows downward;

the LP nitrogen-enriched stream is introduced at the bottom of the multiple stage contacting column or the mixing column and flows upward; and the first mixed nitrogen-oxygen fluid is output from adjacent the bottom of the multiple stage contacting column or the mixing column as a liquid; and a second mixed nitrogen-oxygen fluid is recovered from adjacent the top of the multiple stage contacting column or the mixing column as a vapor.

10. The process of claim 1, wherein:

the at least partially condensing of the argon-rich vapor is a complete condensing to form an argon-rich liquid.

11. A system for separation of a feed gas comprising oxygen, nitrogen, and argon, comprising:

a first column and a second column, the first column being a high pressure (HP) column operatable at a pressure that is higher than the second column, the second column being a low pressure (LP) column operatable at a pressure that is lower than the first column;

a compression system positioned to feed a first feed stream portion of a compressed feed gas to a first heat exchanger to cool the first feed stream portion of the compressed feed gas;

the first heat exchanger positioned to cool the first feed stream portion of the compressed feed gas output from the compression system to feed the cooled compressed first feed stream portion to the HP column to produce an HP nitrogen-rich vapor stream and an HP oxygen-enriched stream;

an HP reboiler-condenser positioned to condense a first portion of the HP nitrogen-rich vapor stream to form an HP condensate stream so that a first portion of the HP condensate stream is recyclable to the HP column;

the LP column positioned and configured to output at least a LP nitrogen-enriched stream, a first LP oxygen-enriched stream, and an LP argon-enriched stream so that the first LP oxygen-enriched stream has an oxygen content of at least 97 mol % oxygen;

a third column positioned to receive the LP argon-enriched stream output from the LP column to form an argon-rich vapor and an argon-depleted liquid, the third column being an argon-enrichment (AE) column, the AE column connected to the LP column so that the argon-depleted liquid output from the third column is feedable to the LP column;

an AE column reboiler-condenser positioned to receive the argon-rich vapor output from the third column to at least partially condense the argon-rich vapor output from the AE column;

a mixing device positioned to mix the LP nitrogen-enriched stream output from the LP column with the first LP oxygen-enriched stream output from the LP column to form a first mixed nitrogen-oxygen fluid to feed to the AE column reboiler-condenser so it is at least partially vaporized to provide at least a portion of a refrigeration duty of the AE column reboiler-condenser for at least partially condensing the first argon-rich vapor; and the AE column reboiler-condenser positioned and connected to the LP column so that a first portion of the at least partially vaporized first mixed nitrogen-oxygen fluid output from the AE column reboiler-condenser is feedable to the LP column.

12. The system of claim 11, wherein:

the compression system is connected to the first heat exchanger such that the compressed feed gas is splittable into the first feed stream portion and a second feed stream portion, the second feed stream portion of the compressed feed gas being feedable to the first heat exchanger to cool the second feed stream portion of the compressed feed gas;

the system also comprising a fourth column to receive the cooled second feed stream portion of the compressed feed gas from the first heat exchanger to produce a nitrogen-rich vapor stream and an oxygen-enriched stream, the fourth column configured to operate at a pressure greater than the pressure at which the HP column is operatable;

the fourth column also connected to the first heat exchanger so that at least a portion of the nitrogen-rich vapor stream output from the fourth column is passable to the first heat exchanger to heat the nitrogen-rich vapor therein to provide a nitrogen product stream;

the fourth column also connected to the HP column so that the oxygen-enriched stream output from the fourth column is feedable to the HP column; and wherein the HP reboiler-condenser is positioned so that the HP condensate stream is splittable into the first portion of the HP condensate stream and a second portion of the HP condensate stream so that the second portion of the HP condensate stream is passable to the fourth column at or adjacent a top of the fourth column.

13. The system of claim 12, comprising:

a fourth column reboiler-condenser positioned to form a condensate that is recyclable to the fourth column; and wherein the fourth column is connected to the HP column so that the oxygen-enriched stream output from the fourth column is passed to the fourth column reboiler-condenser to at least partially vaporize the oxygen-enriched stream for feeding it to the HP column.

14. The system of claim 11, wherein the HP oxygen-enriched stream output from the HP column is splittable into a first portion and a second portion and the mixing device is positioned to mix the first mixed nitrogen-oxygen fluid with the second portion of the HP oxygen-enriched stream to form the mixed nitrogen-oxygen fluid before feeding the mixed nitrogen-oxygen fluid to the AE column reboiler-condenser to provide at least a portion of a refrigeration duty of the AE column reboiler-condenser for the at least partially condensing of the first argon-rich vapor.

15. The system of claim 11, wherein:

the mixing device is positioned to mix of the LP nitrogen-enriched stream output from the LP column with the first LP oxygen-enriched stream output from the LP column and a portion of the HP oxygen-enriched stream for forming the first mixed nitrogen-oxygen fluid.

16. The system of claim 11, comprising:

a phase separator positioned to receive the first mixed nitrogen-oxygen fluid output from the AE column reboiler-condenser to form a nitrogen-oxygen vapor and a nitrogen-oxygen liquid that is feedable to the LP column;

the phase separator positioned and configured so that a second mixed nitrogen-oxygen fluid output from the mixing device is mixable with the nitrogen-oxygen vapor output from the phase separator to form a waste gas stream.

17. The system of claim 11, comprising:

a phase separator positioned and configured to receive the first mixed nitrogen-oxygen fluid output from the AE column reboiler-condenser to form a vapor comprising nitrogen feedable to the mixing device and a nitrogen-oxygen liquid that is feedable to the LP column;

wherein the mixing device is positioned and configured to also receive the vapor comprising nitrogen from the phase separator for mixing the vapor comprising nitrogen with the LP nitrogen-enriched vapor output from the LP column and the first LP oxygen-enriched stream output from the LP column to form the first mixed nitrogen-oxygen fluid.

18. The system of claim 11, wherein the mixing device is a single stage mixing device that is configured to form the first mixed nitrogen-oxygen fluid as a liquid and a second mixed nitrogen-oxygen fluid as a vapor.

19. The system of claim 11, wherein:

the mixing device is a multiple stage column or a mixing column that is positioned and configured such that:

the first LP oxygen-enriched stream is introduced at a top of the multiple stage contacting column or the mixing column and flows downward;

the LP nitrogen-enriched stream is introduced at the bottom of the multiple stage contacting column or the mixing column and is flowable upward;

the first mixed nitrogen-oxygen fluid is output from a bottom of the multiple stage contacting column or the mixing column as a liquid; and a second mixed nitrogen-oxygen fluid is recoverable from the top of the multiple stage contacting column or the mixing column as a vapor.

20. The system of claim 11, wherein the at least partially condensing of the argon-rich vapor is a complete condensing to form an argon-rich liquid.

* * * * *